US009062535B2

(12) United States Patent
Merino et al.

(10) Patent No.: US 9,062,535 B2
(45) Date of Patent: Jun. 23, 2015

(54) WIRELESS NETWORK DISCOVERY ALGORITHM AND SYSTEM

(75) Inventors: Carlos Merino, Paris (FR); Laurent Alteirac, Borgen (NO)

(73) Assignee: Schlumberger Technology Corporation, Sugar Land, TX (US)

( * ) Notice: Subject to any disclaimer, the term of this patent is extended or adjusted under 35 U.S.C. 154(b) by 798 days.

(21) Appl. No.: 12/647,574

(22) Filed: Dec. 28, 2009

(65) Prior Publication Data

US 2011/0158050 A1 Jun. 30, 2011

(51) Int. Cl.

| | |
|---|---|
| ***E21B 47/14*** | (2006.01) |
| ***E21B 47/12*** | (2012.01) |
| ***H01Q 1/04*** | (2006.01) |

(52) U.S. Cl.

CPC ..... *E21B 47/12* (2013.01); *Y10T 29/49002* (2015.01); *Y10T 29/49018* (2015.01); *H01Q 1/04* (2013.01)

(58) Field of Classification Search

CPC ..... G01V 1/40
USPC ..... 367/81
See application file for complete search history.

(56) References Cited

U.S. PATENT DOCUMENTS

| | | | |
|---|---|---|---|
| 5,148,408 | A | 9/1992 | Matthews |
| 5,293,937 | A | 3/1994 | Schultz et al. |
| 5,469,736 | A | 11/1995 | Moake |
| 5,796,677 | A | 8/1998 | Kostek et al. |
| 5,850,369 | A | 12/1998 | Rorden et al. |
| 5,852,587 | A | 12/1998 | Kostek et al. |
| 5,886,303 | A | 3/1999 | Rodney |
| 5,995,449 | A | 11/1999 | Green et al. |
| 6,084,826 | A | 7/2000 | Leggett, III |

(Continued)

FOREIGN PATENT DOCUMENTS

| | | |
|---|---|---|
| EP | 1882811 | 7/2007 |
| EP | 1887181 | 7/2007 |
| EP | 1950586 | 1/2008 |

OTHER PUBLICATIONS

Office Action issued May 22, 2014 in corresponding Mexican Patent Application No. MX/a/2012/007646 and Mexican agent's English translation thereof, 7 pages total.

*Primary Examiner* — Amine Benlagsir
(74) *Attorney, Agent, or Firm* — Cameron R. Sneddon; Diana Sangalli

(57) ABSTRACT

A wireless modem for communication in a network of wireless modems via a communication channel includes a transceiver assembly, transceiver electronics and a power supply. The transceiver electronics include transmitter electronics, receiver electronics and at least one processing unit. The transmitter electronics cause the transceiver assembly to send wireless signals into the communication channel. The receiver electronics decode signals received by the transceiver assembly. The at least one processing unit executes instructions to (1) enable the transmitter electronics to transmit an identification signal into the communication channel, (2) receive data from at least one other wireless modem via the receiver electronics indicative of a unique identifier identifying the other wireless modem, and data indicative of at least one local sensor measurement related to the depth of the other wireless modem below the surface of the Earth, and (3) determine the position and/or relative order of the other wireless modem using the data indicative of the local sensor measurement. The power supply supplies power to the transceiver assembly and the transceiver electronics.

8 Claims, 5 Drawing Sheets

(56) References Cited

U.S. PATENT DOCUMENTS

| | | | | |
|---|---|---|---|---|
| 6,137,747 | A | 10/2000 | Shah et al. | |
| 6,310,829 | B1 | 10/2001 | Green et al. | |
| 6,434,084 | B1 | 8/2002 | Schultz | |
| 6,466,513 | B1 | 10/2002 | Pabon et al. | |
| 6,847,585 | B2 | 1/2005 | Macpherson | |
| 6,899,178 | B2 | 5/2005 | Tubel | |
| 7,139,218 | B2 * | 11/2006 | Hall et al. | 367/82 |
| 7,265,682 | B2 | 9/2007 | Memarzadeh et al. | |
| 7,324,010 | B2 | 1/2008 | Gardner et al. | |
| 7,339,494 | B2 | 3/2008 | Shah et al. | |
| 7,397,388 | B2 * | 7/2008 | Huang et al. | 340/853.3 |
| 7,460,435 | B2 | 12/2008 | Garcia-Osuna et al. | |
| 8,162,055 | B2 * | 4/2012 | Lewis et al. | 166/285 |
| 8,172,007 | B2 * | 5/2012 | Dolman et al. | 175/57 |
| 2002/0195247 | A1 * | 12/2002 | Ciglenec et al. | 166/250.11 |
| 2003/0098799 | A1 | 5/2003 | Zimmerman | |
| 2005/0011645 | A1 * | 1/2005 | Aronstam et al. | 166/250.11 |
| 2005/0022402 | A1 * | 2/2005 | Ash et al. | 33/321 |
| 2005/0035874 | A1 | 2/2005 | Hall et al. | |
| 2006/0114746 | A1 | 6/2006 | Gardner et al. | |
| 2006/0219438 | A1 * | 10/2006 | Moore et al. | 175/50 |
| 2008/0231467 | A1 * | 9/2008 | Jeffryes | 340/854.3 |
| 2008/0236814 | A1 | 10/2008 | Roddy | |
| 2009/0190484 | A1 * | 7/2009 | Johnson et al. | 370/252 |
| 2009/0192731 | A1 * | 7/2009 | De Jesus et al. | 702/42 |
| 2010/0051275 | A1 * | 3/2010 | Lewis et al. | 166/286 |
| 2010/0286916 | A1 * | 11/2010 | Wang | 702/9 |

* cited by examiner

WIRELESS NETWORK DISCOVERY ALGORITHM AND SYSTEM

TECHNICAL FIELD

This invention relates, in general, to wireless telemetry systems for use with installations in oil and gas wells or the like. More particularly, the present invention relates to a method and system for a wireless modem to discover and communicate with other wireless modems for transmitting and receiving data and control signals between a location down a borehole and the surface, or between wireless modems (i.e., a first wireless modem, a second wireless modem, etc.) at various downhole locations.

BACKGROUND

One of the more difficult problems associated with any borehole is to communicate measured data between one or more locations down a borehole and the surface, or between downhole locations themselves. For example, in the oil and gas industry it is desirable to communicate data generated downhole to the surface during operations such as drilling, perforating, fracturing, and drill stem or well testing; and during production operations such as reservoir evaluation testing, pressure and temperature monitoring. Communication is also desired to transmit intelligence from the surface to downhole tools, equipment, or instruments to effect, control or modify operations or parameters.

Accurate and reliable downhole communication is particularly important when complex data comprising a set of measurements or instructions is to be communicated, i.e., when more than a single measurement or a simple trigger signal has to be communicated. For the transmission of complex data it is often desirable to communicate encoded digital signals.

One approach which has been widely considered for borehole communication is to use a direct wire connection between the surface and the downhole location(s). Communication then can be made via electrical signal through the wire. While much effort has been spent on "wireline" communication, its inherent high telemetry rate is not always needed and its deployment can pose problems for some downhole operations.

Wireless communication systems have also been developed for purposes of communicating data between a downhole tool and the surface of the well. These techniques include, for example, communicating commands downhole via (1) electromagnetic waves; (2) pressure or fluid pulses; and (3) acoustic communication. Conventional sonic sources and sensors used in downhole tools are described in U.S. Pat. Nos. 6,466,513, 5,852,587, 5,886,303, 5,796,677, 5,469,736 and 6,084,826, 6,137,747, 6,466,513, 7,339,494, and 7,460,435.

It is useful for the wireless modems to know various data regarding the other wireless modems so that such wireless modems can efficiently communicate. For example, knowledge of the nearest neighbor in a testing pipe string is useful to be energy efficient and to find the shortest path between the surface and the downhole tools, with fewer hops. In fact, the network stabilization is quicker and easier. In the past, wireless modems have been programmed or otherwise adapted to communicate with a known neighboring wireless modem before such wireless modems are installed on a testing pipe string. However, a potentially major problem can arise where a network of wireless modems are programmed to communicate with a known neighboring wireless modem, and where the field engineers assemble the tool string with the network of wireless modems in an improper order/arrangement. In such situation, a communication signal could be lost between hops, preventing data and control signals from transmitting between the surface and a location downhole. As such, there is a need for a new and improved method for finding the identity, position or relative order of wireless modems within a network of wireless modems coupled to a communication channel such as a testing/drill/tubing string. With such a network discovery algorithm, a field engineer does not have to rely on a perfect order of placement for each wireless modem so that the wireless modems will know the identity of their nearest neighbors and thereby ensure a reliable network of communication.

In network industries operating above the surface of the Earth, flooding algorithms are used to discover the neighboring wireless modems. Flood algorithms work very well, however, it is known that they require many exchanges of messages making flood algorithms impractical in a downhole environment where power consumption is important and data rates are much slower.

Despite the efforts of the prior art, there exists a need for a wireless modem that can determine the position or order of other wireless modems in a network communication system in a manner that is suitable for use in a downhole environment.

DISCLOSURE OF THE INVENTION

In one version, the present invention is directed to a wireless modem for communication in a network of wireless modems via a communication channel. The wireless modem is provided with a transceiver assembly, transceiver electronics and a power supply. The transceiver electronics is provided with transmitter electronics and receiver electronics. The transmitter electronics cause the transceiver assembly to send wireless signals into the communication channel, and the receiver electronics decodes signals received by the transceiver assembly. The transceiver electronics is also provided with at least one processing unit executing instructions to (1) enable the transmitter electronics to transmit an identification signal into the communication channel, (2) receive data from at least one other wireless modem via the receiver electronics indicative of a unique identifier identifying the other wireless modem, and data indicative of at least one local sensor measurement related to the depth of the other wireless modem below the surface of the Earth, and (3) determine the position of the other wireless modem using the data indicative of the local sensor measurement. The power supply supplies power to the transceiver assembly and the transceiver electronics.

In one aspect, the at least one processing unit executes instructions to enable the transmitter electronics to transmit data to the other wireless modem.

In another aspect, the data indicative of at least one local sensor measurement includes a communication methodology, such as a time slot indicative of the local sensor measurement. The local sensor measurement can be selected, for example, from the group consisting of a temperature measurement, a pressure measurement, a gravitational acceleration measurement, a magnetic field measurement, and a dip angle measurement.

In another version, the present invention is directed to a wireless modem for communication in a network of wireless modems via a communication channel. The wireless modem can be provided with a transceiver assembly, transceiver electronics, and a power supply. The transceiver electronics includes transmitter electronics, receiver electronics, and at least one processing unit. The transmitter electronics cause the transceiver assembly to send wireless signals into the communication channel. The receiver electronics decode signals received by the transceiver assembly. The at least one processing unit executes instructions to (1) enable the transmitter electronics to transmit an identification signal into the communication channel, (2) receive data from at least one other wireless modem via the receiver electronics indicative of a unique identifier identifying the other wireless modem, and data indicative of at least one local sensor measurement related to the depth of the other wireless modem below the surface of the Earth, and (3) determine the relative order of the other wireless modem using the data indicative of the local sensor measurement. The power supply supplies power to the transceiver assembly and the transceiver electronics.

In one aspect, the at least one processing unit executes instructions to enable the transmitter electronics to transmit data to the other wireless modem.

In another aspect, the data indicative of at least one local sensor measurement includes a communication methodology such as a time slot indicative of the local sensor measurement. The local sensor measurement can be selected from the group consisting of a temperature measurement, a pressure measurement, a gravitational acceleration measurement, a magnetic field measurement, and a dip angle measurement.

In another version, the present invention relates to a wireless modem for communication in a network of wireless modems via a communication channel. The wireless modem can be provided with a transceiver assembly, transceiver electronics, and a power supply. The transceiver electronics includes transmitter electronics, receiver electronics, and at least one processing unit. The transmitter electronics cause the transceiver assembly to send wireless signals into the communication channel. The receiver electronics decode signals received by the transceiver assembly. The at least one processing unit executes instructions to (1) enable the transmitter electronics to transmit an identification signal into the communication channel including a local sensor measurement, (2) receive an answer from at least one other wireless modem via the receiver electronics indicative of a unique identifier identifying the other wireless modem using a communication methodology indicative of at least one local sensor measurement related to the depth of the other wireless modem below the surface of the Earth, and (3) determine at least one of the position and relative order of the other wireless modem. The power supply supplies power to the transceiver assembly and the transceiver electronics. In one aspect, the communication methodology includes a particular time slot.

In another version, the present invention relates to a method for discovering a network of wireless modems in a downhole environment, comprising the steps of coupling a plurality of wireless modems to an elongated member extending from within a borehole to a surface location; and enabling at least one of the wireless modems to transmit a series of identification signals via the elongated member, to receive a series of answers from other wireless modems indicative of local sensor measurements, and to determining at least one of the relative position and relative order of the plurality of wireless modems. In one version, the wireless modems include acoustic transceivers, and the local sensor measurements can be selected from the group consisting of a temperature measurement, a pressure measurement, a gravitational acceleration measurement, a magnetic field measurement, and a dip angle measurement.

In yet another version, the present invention relates to a first wireless modem for communication in a network of wireless modems via a communication channel. The first wireless modem can be provided with a transceiver assembly, transceiver electronics, and a power supply. The transceiver electronics includes transmitter electronics, receiver electronics, and at least one processing unit. The transmitter electronics cause the transceiver assembly to send wireless signals into the communication channel. The receiver electronics decode signals received by the transceiver assembly. The at least one processing unit executes instructions to (1) receive an identification signal from a second wireless modem via the receiver electronics, and (2) enable the transmitter electronics to transmit an answer including data indicative of at least one local sensor measurement of the first wireless modem. The power supply supplies power to the transceiver assembly and the transceiver electronics.

In one aspect, the at least one processing unit executes instructions to compare a local sensor measurement in the identification signal to a local sensor measurement of the first wireless modem to determine whether to create the answer.

In other aspects, the at least one processing unit is programmed to enable the transmitter electronics to transmit the answer in a particular time slot related to the depth of the first wireless modem, or to transmit the answer in a random time slot.

In yet another version, the present invention relates to a method for making a wireless modem, comprising the steps of: connecting a transceiver assembly to transceiver electronics having transmitter electronics, receiver electronics and at least one processing unit suitable for causing the transceiver assembly to transmit and receive wireless signals; and storing a network discovery algorithm on one or more machine readable medium accessible by one or more processing unit of the transceiver electronics with the network discovery algorithm having instructions that when executed by the one or more processing unit cause the one or more processing unit to (1) enable the transmitter electronics to transmit an identification signal into the communication channel, (2) receive data from at least one other wireless modem via the receiver electronics indicative of a unique identifier identifying the other wireless modem, and data indicative of at least one local sensor measurement related to the depth of the other wireless modem below the surface of the Earth, and (3) determine at least one of the position and relative order of the other wireless modem using the data indicative of the local sensor measurement.

These together with other aspects, features, and advantages of the present invention, along with the various features of novelty, which characterize the invention, are pointed out with particularity in the claims annexed to and forming a part of this disclosure. The above aspects and advantages are neither exhaustive nor individually or jointly critical to the spirit or practice of the invention. Other aspects, features, and advantages of the invention will become readily apparent to those skilled in the art from the following detailed description in combination with the accompanying drawings, illustrating, by way of example, the principles of the invention. Accordingly, the drawings and description are to be regarded as illustrative in nature, and not restrictive.

BRIEF DESCRIPTION OF THE SEVERAL VIEWS OF THE DRAWINGS

Implementations of the invention may be better understood when consideration is given to the following detailed description thereof. Such description makes reference to the annexed pictorial illustrations, schematics, graphs, drawings, and appendices. In the drawings.

DETAILED DESCRIPTION

Numerous applications of the present invention are described, and in the following description, numerous specific details are set forth. However, it is understood that implementations of the invention may be practiced without these specific details. Furthermore, while particularly described with reference to transmitting data between a location downhole and the surface during testing installations, aspects of the invention are not so limited. For example, some implementations of the invention are applicable to transmission of data from the surface during drilling, in particular measurement-while-drilling (MWD) and logging-while-drilling (LWD). Additionally, some aspects of the invention are applicable throughout the life of a wellbore including, but not limited to, during drilling, logging, drill stem testing, fracturing, stimulation, completion, cementing, and production.

Figure 1:
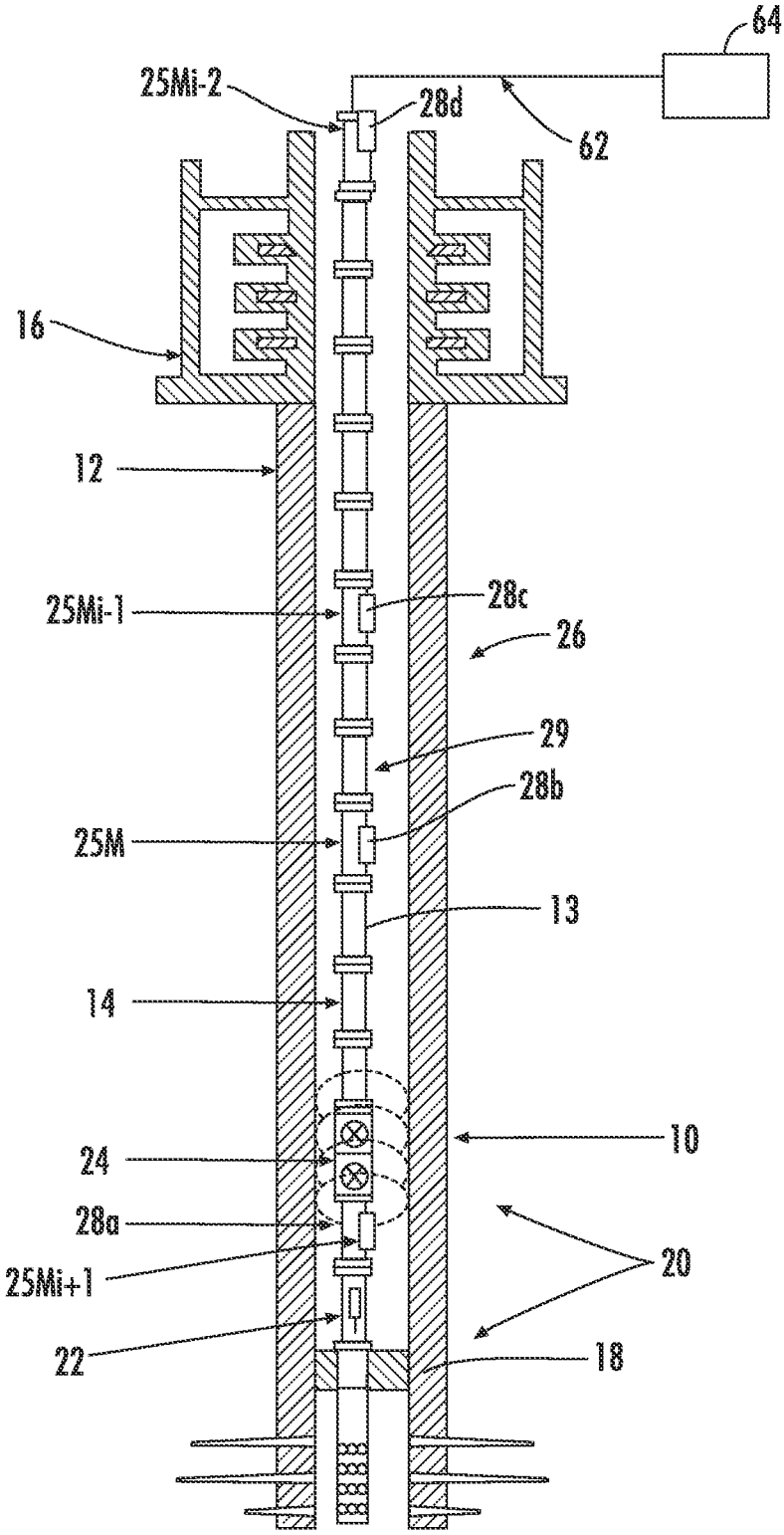
FIG. 1 depicts a schematic view of a wireless telemetry system for use with the present invention.

In particular, however, the present invention is applicable to testing installations such as are used in oil and gas wells or the like. FIG. 1 shows a schematic view of such an installation. Once the well has been drilled, the drilling apparatus is removed from the well and tests can be performed to determine the properties of the formation through which the well has been drilled. In the example of FIG. 1, the well 10 has been drilled, and lined with a steel casing 12 (cased hole) in the conventional manner, although similar systems can be used in uncased (open hole) environments. In order to test the formations, it is necessary to place testing apparatus in the well close to the regions to be tested, to be able to isolate sections or intervals of the well, and to convey fluids from the regions of interest to the surface. This is commonly done using an elastic media 13, such as a drill pipe 14, such as a jointed tubular drill pipe, which extends from the well-head equipment 16 at the surface (or sea bed in subsea environments) down inside the well 10 to a zone of interest. Although the elastic media 13 will be described herein with respect to the drill pipe 14, it should be understood that the elastic media 13 can take other forms in accordance with the present invention, such as production tubing, a drill string, a tubular casing, or the like. The well-head equipment 16 can include blow-out preventers and connections for fluid, power and data communication.

A packer 18 is positioned on the drill pipe 14 and can be actuated to seal the borehole around the drill pipe 14 at the region of interest. Various pieces of downhole equipment 20 for testing and the like are connected to the drill pipe 14, either above or below the packer 18, such as a sampler 22, or a tester valve 24. The downhole equipment 20 may also be referred to herein as a "downhole tool." Other Examples of downhole equipment 20 can include:

Further packers
Circulation valves
Downhole chokes
Firing heads
TCP (tubing conveyed perforator) gun drop subs
Pressure gauges
Downhole flow meters
Downhole fluid analyzers
Etc.

As shown in FIG. 1, the sampler 22 and the tester valve 24 are located above the packer 18. In order to support signal transmission along the drill pipe 14 between the downhole location and the surface, a series of wireless modems 25$M_{i-2}$, 25$M_{i-1}$, 25M, 25$M_{i+1}$, etc. may be positioned along the drill pipe 14 and mounted to the drill pipe 14 via any suitable technology, such as gauge carriers 28*a*, 28*b*, 28*c*, 28*d*, etc. to form a telemetry system 26. The downhole equipment 20 is shown to be connected to the wireless modem 25$M_{i+1}$ positioned between the sampler 22 and tester valve 24. The wireless modems 25$M_{i-2}$, 25$M_{i-1}$, 25M, 25$M_{i+1}$ can be of various types and communicate with each other via at least one communication channel 29 using one or more various protocols. For example, the wireless modems 25$M_{i-2}$, 25$M_{i-1}$, 25M, 25$M_{i+1}$ can be acoustic modems, i.e., electro-mechanical devices adapted to convert one type of energy or physical attribute to another, and may also transmit and receive, thereby allowing electrical signals received from downhole equipment 20 to be converted into acoustic signals for transmission to the surface, or for transmission to other locations of the drill pipe 14. In this example, the communication channel 29 is formed by the elastic media 13 and/or the drill pipe 14 although it should be understood that the communication channel 29 can take other forms. In addition, the wireless modem 25$M_{i+1}$ may operate to convert acoustic tool control signals from the surface into electrical signals for operating the downhole equipment 20. The term "data," as used herein, is meant to encompass control signals, tool status, and any variation thereof whether transmitted via digital or analog signals. It should be noted that in lieu of the drill pipe 14, other appropriate tubular member(s) (e.g., elastic media 13) may be used as the communication channel 29, such as production tubing, and/or casing to convey the acoustic signals.

Figure 2:
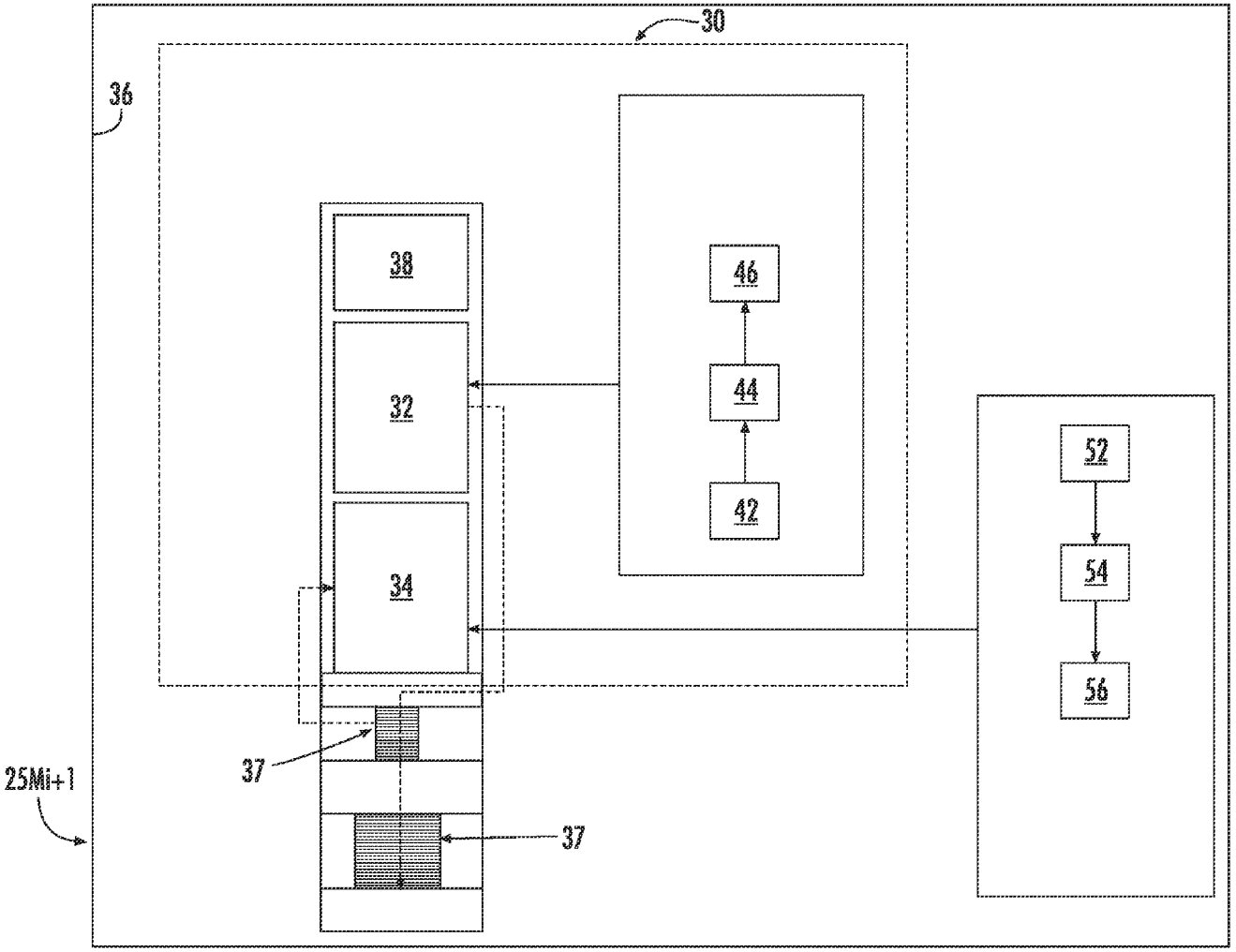
FIG. 2 depicts a partial block diagram of an exemplary wireless modem constructed in accordance with the present invention.

Referring to FIG. 2, the wireless modems 25$M_{i-2}$, 25$M_{i-1}$, 25M, 25$M_{i+1}$ include transceiver electronics 30 including transmitter electronics 32 and receiver electronics 34. The wireless modems 25$M_{i-2}$, 25$M_{i-1}$, 25M, and 25$M_{i+1}$ also include one or more wireless transceiver assembly 37 (two being shown by way of example). The transmitter electronics 32 and receiver electronics 34 may also be located in a housing 36 and power is provided by means of one or more battery, such as a lithium battery 38. Other types of one or more power supply may also be used. The wireless modems 25$M_{i-2}$, 25$M_{i-1}$, 25M, 25$M_{i+1}$ are of similar construction and function except as discussed below. For purposes of brevity, the construction of one of the wireless modems 25 $M_{i+1}$ will be discussed below.

The transmitter electronics 32 are arranged to initially receive an electrical output signal from a sensor 42, for example from the downhole equipment 20 provided from an electrical or electro/mechanical interface. Such signals are typically digital signals which can be provided to one or more processing unit 44 which modulates the signal in one of a number of known ways such as FM, PSK, QPSK, QAM, and the like. The resulting modulated signal is amplified by either a linear or non-linear amplifier 46 and transmitted to the one or more wireless transceiver assembly 37 so as to generate a wireless, e.g., acoustic, signal in the material of the drill pipe 14. The wireless transceiver assembly 37 will be described herein by way of example as an acoustic type of transceiver assembly that converts electrical signals to acoustic signals and vice-versa. However, it should be understood that the wireless transceiver assembly 37 can be embodied in other forms including an electromagnetic transceiver assembly, or a pressure-type transceiver assembly using technologies such as mud-pulse telemetry, pressure-pulse telemetry or the like.

The acoustic signal that passes along the drill pipe 14 as a longitudinal and/or flexural wave comprises a carrier signal which optionally includes an applied modulation of the data received from the sensors 42. The acoustic signal typically has, but is not limited to, a frequency in the range 1-10 kHz, preferably in the range 2-5 kHz, and is configured to pass data at a rate of, but is not limited to, about 1 bps to about 200 bps, preferably from about 5 to about 100 bps, and more preferably about 50 bps. The data rate is dependent upon conditions such as the noise level, carrier frequency, and the distance between the wireless modems 25$M_{i-2}$, 25$M_{i-1}$, 25M, 25$M_{i+1}$. A preferred embodiment of the present invention is directed to a combination of a short hop acoustic telemetry system for transmitting data between a hub located above the main packer 18 and a plurality of downhole equipment such as valves below and/or above said packer 18. The wireless modems 25$M_{i-2}$, 25$M_{i-1}$, 25M, 25$M_{i+1}$ can be configured as repeaters. Then the data and/or control signals can be transmitted from the hub to a surface module either via a plurality of repeaters as acoustic signals or by converting into electromagnetic signals and transmitting straight to the top. The combination of a short hop acoustic with a plurality of repeaters and/or the use of the electromagnetic waves allows an improved data rate over existing systems. The telemetry system 26 may be designed to transmit data as high as 200 bps. Other advantages of the present system exist.

The receiver electronics 34 are arranged to receive the acoustic signal passing along the drill pipe 14 produced by the transmitter electronics 32 of another modem. The receiver electronics 34 are capable of converting the acoustic signal into an electric signal. In a preferred embodiment, the acoustic signal passing along the drill pipe 14 excites the transceiver assembly 37 so as to generate an electric output signal (voltage); however, it is contemplated that the acoustic signal may excite an accelerometer 50 or an additional transceiver assembly 37 so as to generate an electric output signal (voltage). This signal is essentially an analog signal carrying digital information. The analog signal is applied to a signal conditioner 52, which operates to filter/condition the analog signal to be digitalized by an A/D (analog-to-digital) converter 54. The A/D converter 54 provides a digitalized signal which can be applied to a processing unit 56. The processing unit 56 is preferably adapted to demodulate the digital signal in order to recover the data provided by the sensor 42 connected to another modem, or provided by the surface. The type of signal processing depends on the applied modulation (i.e. FM, PSK, QPSK, QAM, and the like).

The wireless modem 25$M_{i+1}$ can therefore operate to transmit acoustic data signals from the one or more sensor 42 in the downhole equipment 20 along the drill pipe 14. In this case, the electrical signals from the downhole equipment 20 are applied to the transmitter electronics 32 (described above) which operate to generate the acoustic signal. The wireless modem 25$M_{i+1}$ can also operate to receive acoustic control signals to be applied to the downhole equipment 20. In this case, the acoustic signals are demodulated by the receiver electronics 34 (described above), which operate to generate the electric control signal that can be applied to the downhole equipment 20.

In order to support acoustic signal transmission along the drill pipe 14 one or more of the wireless modems 25$M_{i-2}$, 25$M_{i-1}$, 25M, 25$M_{i+1}$ may be configured as a repeater and positioned along the drill pipe 14. In the example described herein, the wireless modems 25$M_{i-2}$, 25$M_{i-1}$, and 25M are configured as repeaters and can operate to receive an acoustic signal generated in the drill pipe 14 by a preceding wireless modem 25 and to amplify and retransmit the signal for further propagation along the drill pipe 14. The number and spacing of the repeater modems 25$M_{i-2}$, 25$M_{i-1}$, and 25M, will depend on the particular installation selected, for example or the distance that the signal must travel. A typical spacing between the modems 25$M_{i-2}$, 25$M_{i-1}$, 25M, 25$M_{i+1}$ is around 1,000 ft, but may be much more or much less in order to accommodate all possible testing tool configurations. When acting as a repeater, the acoustic signal is received and processed by the receiver electronics 34 and the output signal is provided to the processing unit 56 of the transmitter electronics 32 and used to drive the transceiver assembly 37 in the manner described above. Thus an acoustic signal can be passed between the surface and the downhole location in a series of short hops.

The role of a repeater modem, for example, 25$M_{i-2}$, 25$M_{i-1}$, and 25M, is to detect an incoming signal, to decode it, to interpret it and to subsequently rebroadcast it if required. In some implementations, the wireless modems 25$M_{i-2}$, 25$M_{i-1}$, and 25M, do not decode the signal but merely amplify the signal (and the noise). In this case the wireless modems 25$M_{i-2}$, 25$M_{i-1}$, and 25M are acting as a simple signal booster. However, this is not the preferred implementation selected for wireless telemetry systems of the present invention.

Wireless modems 25$M_{i-2}$, 25$M_{i-1}$, and 25M are positioned along the tubing/piping string 14. The wireless modems 25$M_{i-2}$, 25$M_{i-1}$, 25M, 25$M_{i+1}$ will either listen continuously for any incoming signal or may listen from time to time.

The acoustic wireless signals, conveying commands or messages, propagate in the transmission medium (the drill pipe 14) in an omni-directional fashion, that is to say up and down. It is not necessary for the wireless modem 25$M_{i+1}$ to know whether the acoustic signal is coming from another wireless modem 25$M_{i-2}$, 25$M_{i-1}$, and/or 25M, above or below. The direction of the message is preferably embedded in the message itself. Each message contains several network addresses: the address of the transmitter electronics 32 (last and/or first transmitter) and the address of the destination modem, for example, the wireless modem 25$M_{i+1}$. Based on the addresses embedded in the messages, the wireless modems 25$M_{i-2}$, 25$M_{i-1}$, and 25M configured as repeaters will interpret the message and construct a new message with updated information regarding the transmitter electronics 32 and destination addresses. Messages being sent from the surface will usually be transmitted from the wireless modem 25$M_{i-2}$ to the wireless modem 25$M_{i-1}$ to the wireless modem 25M, to the wireless modem 25$M_{i+1}$ and slightly modified along the way to include new network addresses.

Referring again to FIG. 1, the wireless modem 25$M_{i-2}$ is provided as part of the well head equipment 16 which provides a connection between the drill pipe 14 and a data cable or wireless connection 62 to a control system 64 that can receive data from the downhole equipment 20 and provide control signals for its operation.

In the embodiment of FIG. 1, the telemetry system 26 is used to provide communication between the surface and the downhole location. In another embodiment, acoustic telemetry can be used for communication between tools in multi-zone testing. In this case, two or more zones of the well are isolated by means of one or more packers 18. Test downhole equipment 20 is located in each isolated zone and corresponding modems, such as the wireless modem 25$M_{i+1}$ are provided in each zone case. Operation of the wireless modems 25$M_{i-2}$, 25$M_{i-1}$, 25M, and 25$M_{i+1}$ allows the downhole equipment 20 in each zone to communicate with each other as well as the downhole equipment 20 in other zones as well as allowing communication from the surface with control and data signals in the manner described above.

References in the specification to "one embodiment", "an embodiment", "an example embodiment", etc. indicate that the embodiments described may include a particular feature, structure or characteristic, but every embodiment may not necessarily include the particular feature, structure or characteristic. Moreover, such phrases are not necessarily referring to the same embodiment. Further, when a particular feature, structure, or characteristic is described in connection with an embodiment, it is submitted that it is within the knowledge of one skilled in the art to effect such future, structure, or characteristic in connection with other embodiments whether or not explicitly described.

Embodiments of the invention with respect to the processing units 44 and 56, and the control system 64 may be embodied utilizing machine executable instructions provided or stored on one or more machine readable medium. A machine-readable medium includes any mechanism which provides, that is, stores and/or transmits, information accessible by the processing units 44 and 56 or another machine, such as the control system 64. The processing units 44 and 56 and the control system 64 include one or more computer, network device, manufacturing tool, or the like or any device with a set of one or more processors, etc., or multiple devices having one or more processors that work together, etc. In an exemplary embodiment, a machine-readable medium includes volatile and/or non-volatile media for example read-only memory, random access memory, magnetic disk storage media, optical storage media, flash memory devices or the like. In one embodiment, the processing units 44 and 56 can be implemented as a single processor, such as a micro-controller, digital signal processor, central processing unit or the like.

Such machine executable instructions are utilized to cause a general or special purpose processor, multiple processors, or the like to perform methods or processes of the embodiments of the invention.

Wireless modems 25 can be programmed with a network discovery algorithm stored by one or more machine readable medium that when executed by the processing units 44 and/or 56 cause one of the wireless modems 25 to discover the identity, position, and/or relative order of other wireless modems 25 which are capable of communicating with each other via the communication channel 29. The network discovery algorithm can be stored as one or more files, one or more sections of instructions, in one or more database as separate or same records, or in any other suitable manner accessible by the processing unit(s) 44 and/or 56.

In general, the processing unit 44 and/or the processing unit 56 of the wireless modems 25 execute instructions of the network discovery algorithm to enable the transmitter electronics 32 to transmit an identification signal into the communication channel 29, (2) receive data from at least one other wireless modem 25 by the receiver electronics 34 indicative of (a) a unique identifier identifying at least one other wireless modem 25, and (b) at least one local sensor measurement related to the depth or altitude of the at least one other wireless modem 25 relative to the surface of the earth, and (3) determine the position, and/or relative order of at least one or more other wireless modem 25 using the data indicative of the local sensor measurement. More particularly, FIGS. 3*a*, 3*b*, 4*a*, and 4*b* illustrate two different versions of the network discovery algorithm for permitting certain ones of the modems 25 to discover the identity, position, and/or relative order of the modems 25 within the network of the telemetry system 26.

The data indicative of at least one local sensor measurement can be provided in a variety of manners, such as information of the local sensor measurement, e.g., 50 degrees centigrade, information used to look up the local sensor measurement from a table or database, or the manner in which the wireless modems 25 communicate, such as a particular protocol or frequency or use of a particular time slot as discussed below with respect to FIGS. 4*a* and 4*b*.

Figure 3A:
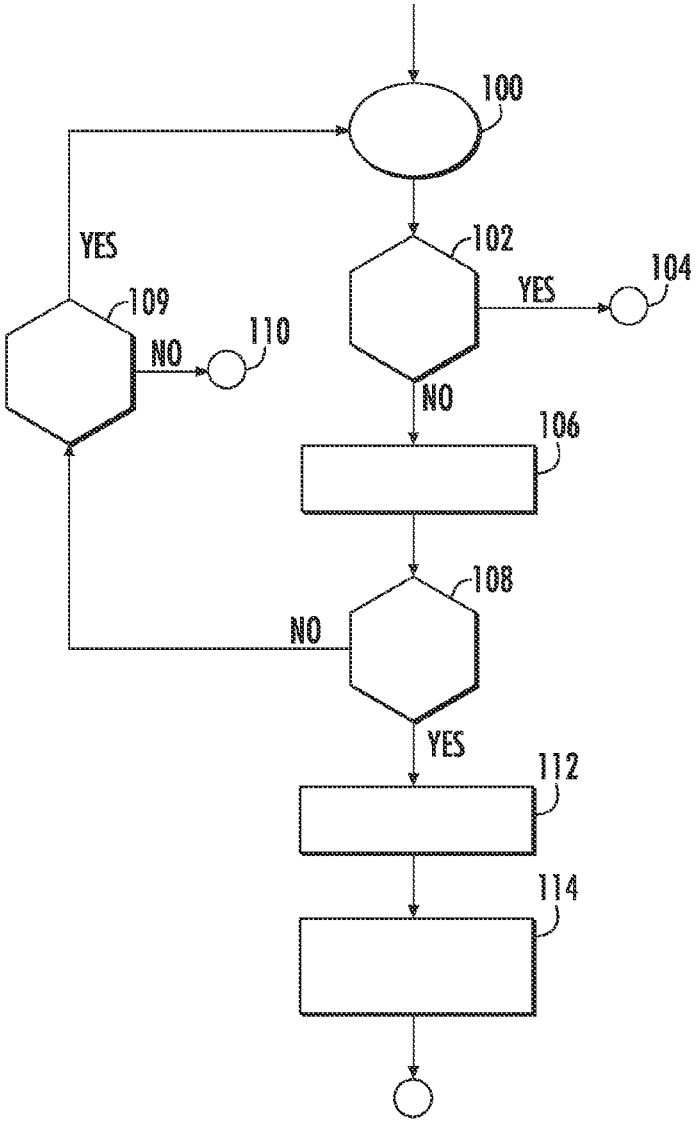
FIGS. 3*a* and 3*b* depict logic flow diagrams of a method for discovering a network of wireless modems in a downhole environment in accordance with one aspect of the present invention.
Figure 3B:
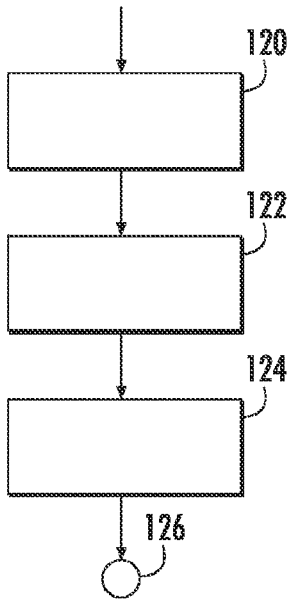

Referring now to FIGS. 3*a* and 3*b*, such Figures cooperate to illustrate the logic of a version of the network discovery algorithm operating within a wireless modem 25. FIG. 3*a* illustrates a portion of the network discovery algorithm trying to discover the identity (e.g., a network or IP address), position (e.g., 1000 feet below the surface of the Earth), and/or relative order (e.g., 2000 feet below the wireless modem 25 transmitting the identification signal) of the other modems 25. FIG. 3*b* illustrates a portion of the network discovery algorithm where one of the other modems 25 is responding to a request (discussed herein as an identification signal) from the other modem 25.

As shown in FIG. 3*a*, the network discovery algorithm begins as indicated by a block 100, and branches to a block 102 where the network discovery algorithm determines whether this particular modem 25 knows information such as identity, position, and/or relative order of the other modems 25 within the network. The other modems 25 within the network can be referred to as "neighbors". If the wireless modem 25 already knows the identity, position, and/or relative order of the other modems 25, then the network discovery algorithm branches to a block 104 thereby either ending the network discovery algorithm or branching to the portion of the network discovery algorithm depicted in FIG. 3*b* that is monitoring the receiver electronics 34. If not, the network discovery algorithm branches to a block 106 wherein the network discovery algorithm causes the processing unit 44 and/or 56 to transmit the identification signal into the communication channel 29. The identification signal includes at least a network address or other type of identification information identifying the particular modem 25 transmitting the identification signal so that other modems 25 can reply to the correct modem 25. The identification signal can include further information such as one or more local sensor measurement provided by or sensed by the sensor 42, for example. Once the identification signal has been transmitted into the communication channel 29, the network discovery algorithm branches to a step 108 where the network discovery algorithm monitors the receiver electronics 34 to determine whether any answers have been received from other wireless modems 25 within the network. If no answers have been received (or all of the answers have been received), then the network discovery algorithm branches to a step 109 where the network discovery algorithm determines whether to try to locate any further information with respect to the other modems 25. If the network discovery algorithm determines to send another identification signal then the network discovery algorithm branches to the block 100, and if not the network discovery algorithm branches to a block 110 thereby either ending the network discovery algorithm or branching to the portion of the network discovery algorithm depicted in FIG. 3*b* that is monitoring the receiver electronics 34. The network discovery algorithm can determine whether to continue requesting further information from the other modems 25 using any suitable manner, such as a fixed number of requests, dynamic number of requests, or the like.

If the network discovery algorithm determines that any answers have been received in the step 108, then such network discovery algorithm branches to a step 112 where the network discovery algorithm compares its own local sensor measurement with data indicative of a measurement received from another one of the wireless modems 25, and then the network discovery algorithm branches to a step 114 where it determines the identification, position and/or relative order of the wireless modems 25 that have answered. The network discovery algorithm can determine the identification, position, and/or relative order in any suitable manner, however, it is specifically contemplated that the local sensor measurements taken by the particular wireless modems 25 are correlated to the depth of the particular wireless modems 25. This correlation will be described in more detail below.

When a particular wireless modem 25 broadcasts the identification signal as discussed above in step 106, such identification signal can be received and decoded by the other wireless modems 25 within the network. As shown in FIG. 3*b*, the network discovery algorithm executed by the wireless modems 25 causes the wireless modems 25 to monitor the receiver electronics 34 and wait to receive an identification signal from another one of the wireless modems 25, as indicated by step 120. Once the network discovery algorithm receives the identification signal utilizing the receiver electronics 34, the network discovery algorithm branches to a step 122 where the network discovery algorithm enables the processing unit 44 and/or 56 to create an answer that includes its local sensor measurement related to its depth within the well bore or altitude above the well-bore. The network discovery algorithm then branches to a step 124 where the network discovery algorithm causes the processing unit 44 and/or 56 to enable the transmitter electronics 32 to transmit the answer, preferably in a random timeslot.

The particular wireless modem 25 that transmitted the identification signal in the step 106, then receives the answer and processes such answer as discussed above with respect to steps 108, 112, and 114 to determine information regarding its neighbors. After the wireless modem 25 transmits its answer in a random timeslot, for example, as indicated by the step 124, such network discovery algorithm branches to a step 126 where the network discovery algorithm waits to receive a further identification message.

Figure 4A:
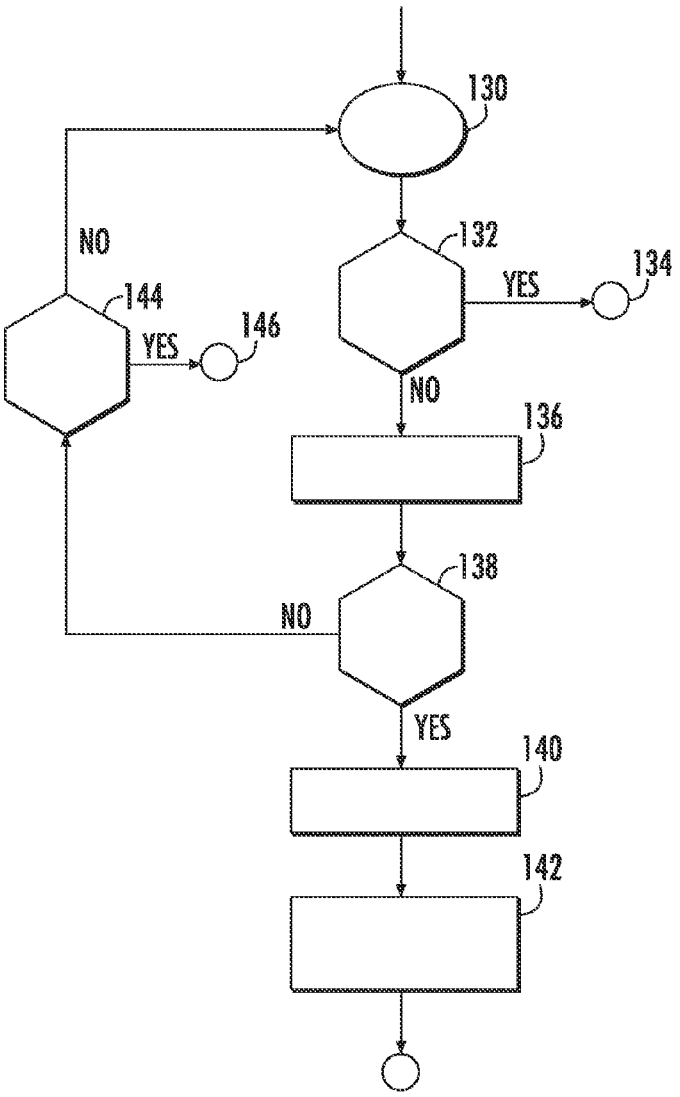
FIGS. 4*a* and 4*b* depict logic flow diagrams of an alternative method for discovering a network of wireless modems in a downhole environment in accordance with another aspect of the present invention.
Figure 4B:
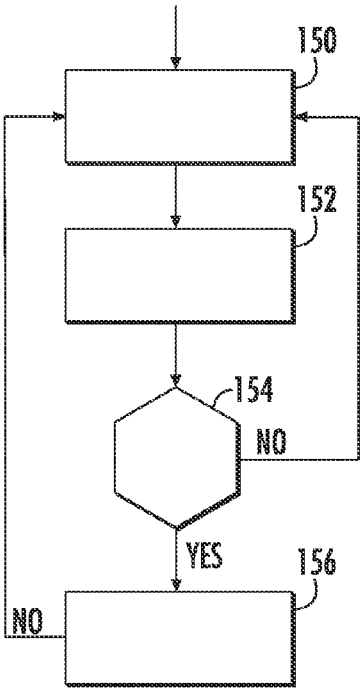

Referring to FIGS. 4*a* and 4*b*, shown therein is another version of the network discovery algorithm in which FIG. 4*a* shows the network discovery algorithm from the standpoint of the wireless modem 25 who is trying to discover the identity, position and/or relative order of the other wireless modems 25 within the network, while FIG. 4*b* illustrates the network discovery algorithm from the standpoint of the other wireless modems 25 that are being discovered.

As shown in FIG. 4*a*, the network discovery algorithm starts as indicated by a step 130, and then branches to a step 132 which is similar to the step 102 discussed above, where the particular wireless modem 25 determines whether it knows the identity, position, and/or relative order of the other wireless modems 25 within the network. If so, then the network discovery algorithm branches to a step 134, and if not, the network discovery algorithm branches to the step 136 where such network discovery algorithm enables the transmitter electronics 32 to transmit the identification signal into the communication channel 29 with the identification signal including an identification, such as network address, of the wireless modem 25, and the wireless modem's 25 local sensor measurement derived by utilizing the sensor 42, for example. The network discovery algorithm branches to a step 138 which is similar to the step 108 discussed above. In the step 138, the network discovery algorithm monitors the receiver electronics 34 to see if any answer(s) have been received, and if so, the network discovery algorithm branches to a step 140 to determine which time slot the answer was transmitted within. The network discovery algorithm then branches to a step 142 and determines the position, and/or relative order of the wireless modem 25 based upon the timeslot, for example, in which the answer was received. The network discovery algorithm then branches to the step 138 to determine whether any other answers were received and if not, branches to a step 144 to see if it should broadcast its identification signal again and if so branches to the block 130, and if not branches to the block 146.

Referring now to FIG. 4*b*, shown therein is a portion of the network discovery algorithm which can be executed by the processing unit 44 and/or 56 of the wireless modems 25 and functions to provide answers to the identification signal broadcasted by the particular wireless modem 25 trying to discover the identity, position and/or relative order of the other wireless modems 25 within the network. As shown in FIG. 4*b*, the network discovery algorithm branches to a step 150 where the receiver electronics 34 waits to receive an identification signal containing a local sensor measurement of another wireless modem 25. If so, the network discovery algorithm branches to a step 152 and compares its own local sensor measurement with the local sensor measurement that was received. Once the comparison is completed, the network discovery algorithm branches to a step 154 where it determines whether to create an answer using any suitable logic, such as the distance from the from the wireless modem 25 transmitting the identification message. For example, the wireless modems 25 could be programmed to only wait two timeslots (due to total time limitations). In this case, if a particular wireless modem 25 was more than two hops away from the wireless modem 25 transmitting the identification signal, then the particular wireless modem 25 would not create an answer. If the network discovery algorithm decides or determines to create an answer, the network discovery algorithm branches to a step 156 where it enables the transmitter electronics 32 to answer using data indicative of the local sensor measurement. For example, the answer can be transmitted in a precise timeslot according to the measurement comparison, or using another type of predefined communication scheme, such as a particular predetermined protocol or frequency. Thereafter, the network discovery algorithm branches to the step 150 to wait to receive another identification signal.

Figure 5A:
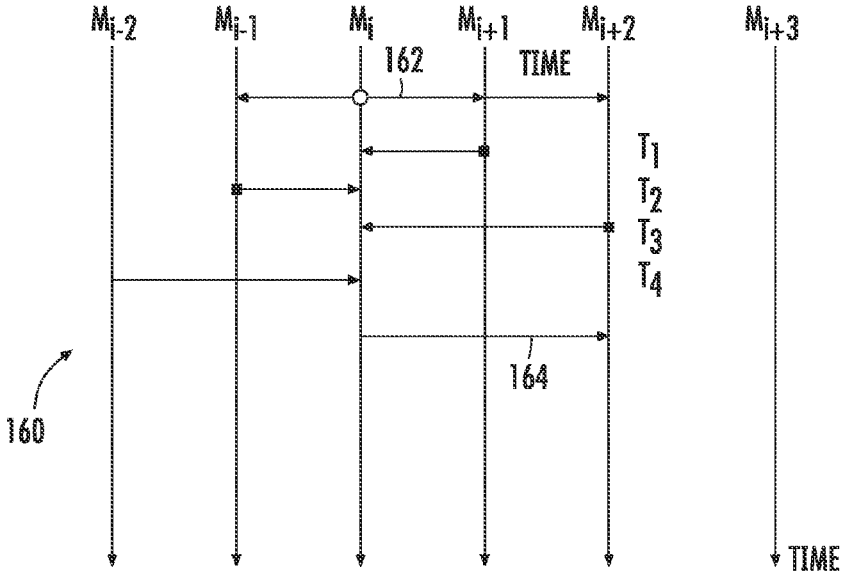
FIGS. 5*a* and 5*b* depict timing diagrams of versions of the interaction of several wireless modems in accordance with the methods depicted in FIGS. 4*a* and 4*b*.

FIG. 5*a* is a timing diagram of a version of the network discovery algorithm illustrated in FIGS. 4*a* and 4*b*. In particular, FIG. 5 depicts the timing of the interaction of five wireless modems 25 communicating on the communication channel 29. In the example depicted in FIG. 5, the wireless modem 25M transmits the identification signal as shown in step 136 of FIG. 4*a*. The identification signal is received by the wireless modems 25$M_{i-2}$, 25$M_{i-1}$, 25$M_{i+1}$ and 25$M_{i+}$2. As shown in FIG. 5, the wireless modems 25$M_{i-2}$, 25$M_{i-1}$, 25$M_{i+1}$ and 25$M_{i+}$2 receive the identification signals, compare the local sensor measurement within the identification signal with their own local sensor measurement and reply to the identification signal based upon predetermined time slots, for example. In the example depicted in FIG. 5, the wireless modems 25$M_{i+1}$ and 25$M_{i+}$2 which have a depth greater than the wireless modem 25M reply on odd number time slots based upon their relative position with respect to the wireless modem 25M. Similarly, the wireless modems 25$M_{i-2}$, 25$M_{i-1}$ which have a depth less than the depth of the wireless modem 25M respond on even time slots based upon their relative position with respect to the wireless modem 25M. The wireless modem 25$M_{i+1}$ responds in the first timeslot, the wireless modem 25$M_{i-1}$ responds in the second timeslot, the wireless modem 25$M_{i+2}$ responds in the third timeslot, and the wireless modem 25$M_{i-2}$ responds in the fourth timeslot. The wireless modem 25M receives and stores the answers including the identification information of the other wireless modems 25$M_{i-2}$, 25$M_{i-1}$, 25$M_{i+1}$ and 25$M_{i+}$2 within the network along with their position and/or relative order, and then transmits directly to the wireless modem 25$M_{i+2}$ utilizing the identification information received in the answer from the wireless modem 25$M_{i+2}$.

In this example, the wireless modems 25$M_{i-2}$, 25$M_{i-1}$, 25M, 25$M_{i+1}$ and 25$M_{i+}$2. can be placed along the drill pipe 14 separated with a 1000 m spacing. The local sensor measurement can be temperature or pressure since it is known that the relation between depth and pressure, for example, is:

$$P_i=\rho_{mud}\cdot g\cdot d_i$$

where $\rho_{mud}$ is the density of the mud in the annular, g is the gravity acceleration and $d_i$ is the distance measured from the surface. It can be assumed that the temperature at the surface is 25° C. and the gradient of the temperature in the pipe is 25° C./Km For example, assuming $\rho_{mud}=1.5\cdot\rho_{water}$ and $g=10\ ms^{-2}$:

| Depth (m) | Pressure (Pa) | Pressure(bar) | Temperature(C.) |
|---|---|---|---|
| 1000 | $1.5\ 10^7$ | 150 | 50 |
| 2000 | $3\ 10^7$ | 300 | 75 |
| 3000 | $4.5\ 10^7$ | 450 | 100 |
| 4000 | $6\ 10^7$ | 600 | 125 |
| 5000 | $7.5\ 10^7$ | 750 | 150 |

If each wireless modem 25 interchanges its local sensor measurement with its neighbors, the other modems 25 position, and/or relative order of the wireless modems 25 can be determined using a correlation similar to the one shown above. The term local sensor measurement, as used herein, refers to a measurement of an environmental condition associated with a particular wireless modem 25 that is sufficiently precise to distinguish the particular wireless modem's measurement from the measurements of the other wireless modems 25. The sensor 42 can be part of the downhole equipment 20 or part of the wireless modem 25. The local sensor measurements can be taken in a borehole or any other suitable locations associated with the wireless modems 25. Examples of local sensor measurements include a temperature measurement, a pressure measurement, a gravitational acceleration measurement, a magnetic field measurement, a dip angle measurement and combinations thereof.

Figure 5B:
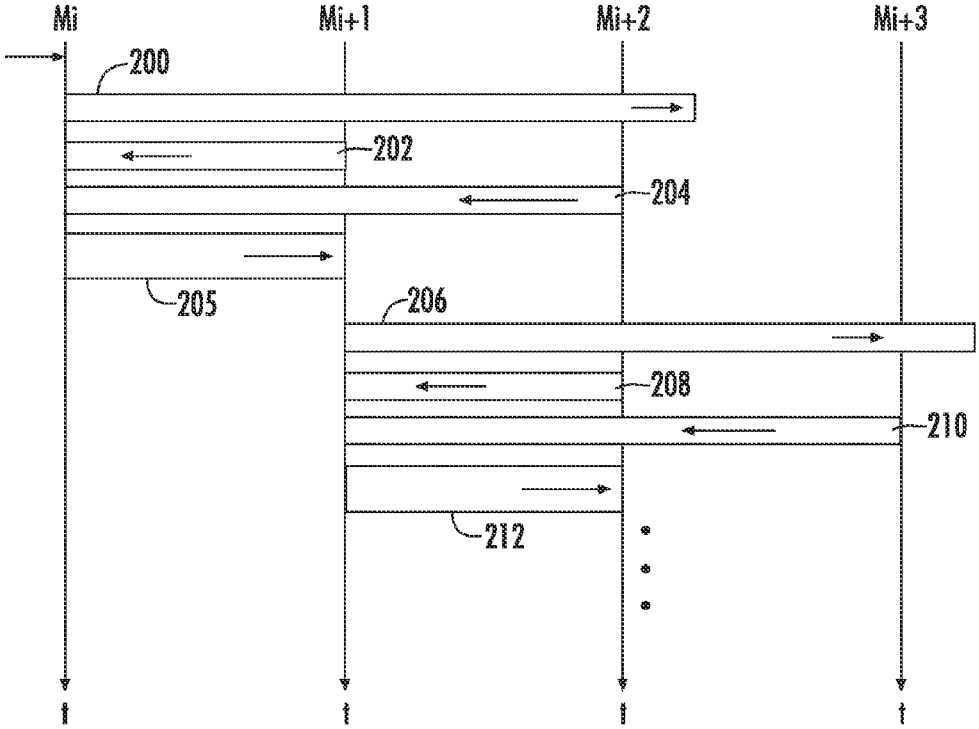

Referring now to FIG. 5*b*, shown therein is an alternative version of the interaction of several wireless modems 25$M_i$, 25$M_{i+1}$, 25$M_{i+}$2, 25$M_{i+3}$ in accordance with the methods depicted in FIGS. 4*a* and 4*b*. In this version, at the step 154 (depicted in FIG. 4*b*) the wireless modems 25 determine whether to create an answer as follows. In the step 152, the wireless modems 25 which receive an identification signal compare their own local sensor measurement with the local sensor measurement in the identification signal. Then, in the step 154, the wireless modems 25 create an answer if (1) such wireless modems 25 are at a depth deeper than the wireless modem that transmitted the identification signal, and (2) are within two hops of the wireless modem 25 that transmitted the identification signal. Thus, as shown in FIG. 5*b*, the wireless modem 25 $M_i$, broadcasts an identification signal including its local sensor measurement as indicated by step 200, and wireless modems 25$M_{i+1}$, and 25$M_{i+2}$ create answer as indicated by steps 202 and 204 while wireless modem 25$M_{i+3}$ does not. Then, the next deeper wireless modem 25$M_{i+1}$, transmits an identification signal as indicated by step 206 and wireless modems 25$M_{i+2}$ and 25$M_{i+3}$ create an answer as indicated by steps 208 and 210. This process repeats as indicated by step 212 until the deepest wireless modem 25$M_{i+3}$ transmits an identification signal, but an answer is not received. At this point, all of the wireless modems 25 know the identification, position and/or order of at two or more of the wireless modems 25 to communicate with.

It should be understood that the components of the inventions set forth above can be provided as unitary elements, or multiple elements which are connected and/or otherwise adapted to function together, unless specifically limited to a unitary structure in the claims.

From the above description it is clear that the present invention is well adapted to carry out the disclosed aspects, and to attain the advantages mentioned herein as well as those inherent in the invention. While presently preferred implementations of the invention have been described for purposes of disclosure, it will be understood that numerous changes may be made which readily suggest themselves to those skilled in the art and which are accomplished within the spirit of the invention disclosed.

What is claimed is:

1. A wireless modem for communication in a network of wireless modems via a communication channel in a downhole environment, the wireless modem comprising:

a transceiver assembly;

transceiver electronics, comprising:

transmitter electronics to cause the transceiver assembly to send wireless signals into the communication channel;

receiver electronics to decode signals from a plurality of other wireless modems received by the transceiver assembly;

at least one processor executing instructions to (1) enable the transmitter electronics to transmit an identification signal into the communication channel, (2) receive data from at least one other wireless modem via the receiver electronics indicative of a unique identifier identifying the at least one other wireless modem, and data representative of at least one first local sensor measurement made by at least one first local sensor associated with the at least one other wireless modem of a parameter that is related to a depth of the at least one other wireless modem below a surface of the Earth, and (3) determine a relative order and a position of the at least one other wireless modem in the network of wireless modems along the communication channel using a comparison between the data representative of the at least one first local sensor measurement of the parameter that is related to the depth of the at least one other wireless modem and data representative of a second local sensor measurement made by a second local sensor associated with the wireless modem, wherein the data representative of the at least one first local sensor measurement includes a time slot, and wherein the relative order and the position of the at least one other wireless modem is determined in part based on which available time slot of a plurality of available time slots contains the data representative of the at least one first local sensor measurement received from the at least one other wireless modem; and a power supply supplying power to the transceiver assembly and the transceiver electronics.

2. The wireless modem of claim 1, wherein the at least one processor further executes instructions to enable the transmitter electronics to transmit the data representative of the second local sensor measurement made by the second local sensor associated with the wireless modem to the at least one other wireless modem.

3. The wireless modem of claim 1, wherein the at least one first local sensor measurement is selected from a group consisting of a temperature measurement, a pressure measurement, a gravitational acceleration measurement, a magnetic field measurement, and a dip angle measurement.

4. A wireless modem for communication in a network of wireless modems via a communication channel in a downhole environment, the wireless modem comprising:

a transceiver assembly;

transceiver electronics, comprising:

transmitter electronics to cause the transceiver assembly to send wireless signals into the communication channel;

receiver electronics to decode signals from a plurality of other wireless modems received by the transceiver assembly;

at least one processor executing instructions to (1) enable the transmitter electronics to transmit an identification signal into the communication channel, (2) receive data from at least one other wireless modem via the receiver electronics indicative of a unique identifier identifying the at least one other wireless modem, and data representative of at least one first local sensor measurement made by at least one first local sensor associated with the at least one other wireless modem of a parameter related to a depth of the at least one other wireless modem below a surface of the Earth, and (3) determine a relative order of the at least one other wireless modem in the network of wireless modems along the communication channel using a comparison between the data representative of the at least one first local sensor measurement of the parameter related to the depth of the at least one other wireless modem and data representative of a second local sensor measurement made by a second local sensor associated with the wireless modem, wherein the data representative of the at least one first local sensor measurement includes a time slot, and wherein the relative order of the at least one other wireless modem is determined in part based on which available time slot of a plurality of available time slots contains the data representative of the at least one first local sensor measurement received from the at least one other wireless modem; and a power supply supplying power to the transceiver assembly and the transceiver electronics.

5. The wireless modem of claim 4, wherein the at least one processor further executes instructions to enable the transmitter electronics to transmit the data representative of the second local sensor measurement made by the second local sensor to the at least one other wireless modem.

6. The wireless modem of claim 4, wherein the at least one first local sensor measurement is selected from a group consisting of a temperature measurement, a pressure measurement, a gravity measurement, and a magnetic measurement.

7. A wireless modem for communication in a network of wireless modems via a communication channel in a downhole environment, the wireless modem comprising:

a transceiver assembly;

transceiver electronics, comprising:

transmitter electronics to cause the transceiver assembly to send wireless signals into the communication channel;

receiver electronics to decode signals from a plurality of other wireless modems received by the transceiver assembly;

at least one processor executing instructions to (1) enable the transmitter electronics to transmit an identification signal into the communication channel including a first local sensor measurement made by a first local sensor associated with the wireless modem of a parameter that is related to a depth of the wireless modem below a surface of the Earth, (2) receive an answer from at least one other wireless modem via the receiver electronics indicative of a unique identifier identifying the at least one other wireless modem, wherein the answer is transmitted using a communication methodology, and (3) determine a relative order of the at least one other wireless modem in the network of wireless modems along the communication channel based on a result of a comparison between the first local sensor measurement and at least one second local sensor measurement made by at least one second local sensor associated with the at least one other wireless modem of a parameter that is related to a depth of the at least one other wireless modem below the surface of the Earth, wherein the at least one second local sensor measurement includes a time slot, and the relative order of the at least one other wireless modem is determined in part based on which available time slot of a plurality of available time slots contains the at least one second local sensor measurement received from the at least one other wireless modem; and a power supply supplying power to the transceiver assembly and the transceiver electronics.

8. A method for discovering a network of wireless modems in a downhole environment using a wireless modem, comprising:

connecting a transceiver assembly to transceiver electronics, wherein the transceiver electronics having: transmitter electronics, receiver electronics and one or more processors, wherein the one or more processors suitable for causing the transceiver assembly to transmit and receive wireless signals, and wherein the wireless modem comprises the transceiver assembly and the transceiver electronics; and storing a network discovery algorithm on one or more machine readable medium accessible by the one or more processors of the transceiver electronics with the network discovery algorithm having instructions that when executed by the one or more processors cause the one or more processors to (1) enable the transmitter electronics to transmit an identification signal into a communication channel, (2) receive data from at least one other wireless modem via the receiver electronics indicative of a unique identifier identifying the at least one other wireless modem, and data representative of at least one first local sensor measurement of a parameter monitored by at least one first local sensor associated with the at least one other wireless modem that is related to a depth of the at least one other wireless modem below a surface of the Earth, and (3) determine a relative order of the at least one other wireless modem in the network of wireless modems along the communication channel using a comparison between the data representative of the at least one first local sensor measurement of the parameter that is related to the depth of the at least one other wireless modem and data representative of a second local sensor measurement made by a second local sensor associated with the wireless modem, wherein the data representative of the at least one first local sensor measurement includes a time slot, and wherein the relative order of the at least one other wireless modem is determined in part based on which available time slot of a plurality of available time slots contains the data representative of the at least one first local sensor measurement received from the at least one other wireless modem.

* * * * *